United States Patent [19]

George

[11] 4,418,856

[45] Dec. 6, 1983

[54] APPARATUS FOR PLAITING TOW ONTO A CONVEYOR

[75] Inventor: Kurudamannil A. George, Philadelphia, Pa.

[73] Assignee: Proctor & Schwartz, Inc., Horsham, Pa.

[21] Appl. No.: 111,544

[22] Filed: Jan. 14, 1980

[51] Int. Cl.[3] ..... B65H 17/42

[52] U.S. Cl. ..... 226/118; 28/281; 226/196; 34/159; 198/404

[58] Field of Search ..... 226/119, 113, 200, 118, 226/196; 28/281, 218; 34/159, 161, 105; 198/404

[56] References Cited

U.S. PATENT DOCUMENTS

| | | | |
|---|---|---|---|
| 2,598,000 | 5/1952 | Knopp et al. | 28/281 X |
| 3,302,839 | 2/1967 | Spruill | 226/200 X |
| 3,318,013 | 5/1967 | Erb | 28/281 X |
| 3,332,595 | 7/1967 | Wetzler | 226/119 |
| 3,672,819 | 6/1972 | Katsutama et al. | 28/281 X |

*Primary Examiner*—Jeffrey V. Nase

*Attorney, Agent, or Firm*—R. A. Sturges; M. H. Douthitt; R. H. Thomas

[57] ABSTRACT

An inverting tow plaiter adapted to position tow onto a receiving end of a main conveyor in a series of overlying laps oriented to permit trouble-free removal of tow from the main conveyor discharge end. The plaiter comprises a continuous, moving canvas belt positioned above the main conveyor constrained to follow the downwardly extending semi-circular path, and a stationary housing spaced from the belt to define with the belt a curved chute of narrowing cross-section. The chute has a gap width at the chute upper end which is greater than at the chute lower end. Structure for depositing tow onto the canvas belt at the chute upper end in a series of overlying laps which extend transversely across the belt is provided.

6 Claims, 2 Drawing Figures

APPARATUS FOR PLAITING TOW ONTO A CONVEYOR

The present invention relates to a device for continuously feeding lengths of textile material onto a dryer conveyer, and is specifically directed to feeding tow onto a conveyor.

BACKGROUND OF THE INVENTION

Polyester, nylon, or rayon yarn is usually produced by polymerization of the synthetic material, free of all water, into small cubes followed by the production of monofilaments from the cubes accomplished by subjecting the synthetic material to melting, and then extrusion thru a large number of small nozzles. The extruded fibers are collected in large cans in the form of what is called "ends". These cans are then arranged at the front end of a stretch line and as many as 40 ends may be combined to form, without twisting, a bundle of monofilaments known as polyester, rayon, or nylon tow. Conventionally, the tow is fed through the stretch line where it is lengthened by stretching, reducing the monofilament diameter and orienting the fiber molecules. The tow may be heat-set on the stretch line, and then crimped and fed to a dryer where it is dried. Alternatively, the tow may be subjected to heat-set as well as drying in the dryer by heating it to a temperature as high as about 250°–400° F. In either case, the crimped tow following drying is cut into short lengths to form staple which is then twisted or spun by a user to produce yarn.

Drying is necessitated by a number of wet treatments during the processing, for instance desulfurizing, washing, and bleaching, following extrusion (U.S. Pat. No. 2,657,433), or other steps depending upon the particular synthetic material employed. Immediately before the drying stage, the tow is a compact but mangled mass which is difficult to dry uniformly because of a small ratio of surface area to unit volume and difficulty of heat penetration into the central filaments. Accordingly, it has been found advantageous and most efficient to dry the tow in a folded condition or a series of laps or plaits, with the lap overlying an adjacent lap. The amount of overlap of successive plaits may be as high as 50–90%.

It is not feasible simply to lay the tow onto a dryer continuous conveyor in successive overlying laps as a leading lap will be positioned beneath the next following lap. At the exit or discharge end of the layer, the tow will then have to be removed by pulling it from underneath more rearward laps and against the conveyor belt, and depending upon the degree of overlap, severe stretch or stretching of the tow and entangling of the tow laps can occur.

It is known to employ a device referred to as a J-box or similar apparatus for the inversion of the tow laps prior to positioning the same on a dryer conveyor. An example of such an apparatus is shown in British Pat. No. 1,121,486, for instance in FIG. 8 of the patent. Generally, the J-box is in the form of an open top chute, having a rectangular cross section and in an elevation sideview, a J configuration with a generally vertical upper long leg and a shorter lower leg sloping downwardly at an angle to the vertical leg. Lengths of fabric are folded into the J-box upper open end, and the weight of the piled-up material forces the same to pass downwardly in the J-box exiting through the short leg onto a conveyor. By virtue of the general shape of the J-box, the folds (laps or plaits) come to rest on the conveyor in an approximate upright position.

In the apparatus of the '486 patent, means are provided to lay the tow material in the top of the J-box in horizontal, short folds which extend back and forth from front to back, viewed from the side of the apparatus. The short folds have a lot of resilience and spring action and, hence, move uniformly down the J-box onto a conveyor.

The present invention by contrast is concerned with plaiting tow in relatively long laps or plaits which extend from side to side, for instance three to six foot laps. Whereas the short webbing folds have resilience and spring action, tow when plaited from side to side in long laps does not have such resilience or spring action. Further, the tow at one point may have a very rectangular cross-section, so that it extends fully between the front and back sides of the J-box, and at another point a more square cross-section so that it is spaced from the sides. As the tow laps travel downwardly in a J-box, confined by the parallel sides of the box, tow which is relatively thin in cross-section will meet less resistance and tend to compress more than tow of thicker cross-section. If this variable compression is translated to the tow deposited on the conveyor, the frequency of laps on the conveyor will vary, resulting in non-uniform drying of the tow. The situation can be aggravated further if tow of unusually high thickness enters the J-box and becomes held up by the sides to the extent that stoppage of the flow of tow results.

A variation of the J-box structure is also illustrated in the '486 patent, for instance in FIG. 6. In this environment, a pair of rollers move to and fro serving as a folding device for laying tow material onto the upper side of a revolving perforated drum, the rollers moving horizontally and at right angles to the axis of the drum. The drum has the purpose of inverting or what is called reversing the folds of material and passing them to a subsequent conveying means. This is accomplished by employing a curved vibrator conveyor spaced a certain distance from the drum and adapted to the curvature of the drum. Material folded onto the drum is guided on both sides by the drum and vibrator conveyor for a certain distance until substantially diametrically opposite the folding point. At this opposite point, the folds of material leave the surface of the drum in an orientation such that they can be drawn off at a discharge end without damage. This embodiment or structure, as with the J-box structure, is suitable for short folds of tow which have resilience or spring action, but the apparatus lacks suitability for use with longer laps up to three to six feet in length, which have little resilience and spring action. To plait tow across the entire width of the apparatus onto an upper curved surface can easily result in uneven layer down of the tow and uneven movement of displacement of the laps at one side of the apparatus compared to the other side.

A similar device is shown in a Wetzler U.S. Pat. No. 3,332,595. In this patent, there is shown an endless belt conveyor between two sprockets onto which the tow is deposited, in an undulating back and forth movement similar to that of British Pat. No. 1,121,486. Here also, the short webbing folds have resilience and spring action and will move as shown in the patent. In contrast, tow when plaited side to side does not have such resilience or spring action and hence will not be inverted. In addition, there is provided in the Wetzler patent an outer curved wall spaced from the conveyor belt, which extends below the belt downwardly to a second horizontal conveyor. In the area between the upper conveyor belt and the lower conveyor belt, long tow plaits or laps would be virtually unsupported, and would tend to randomly tumble down to the lower conveyor belt and become nonuniformly positioned on the lower belt.

SUMMARY OF THE INVENTION

The above and other disadvantages are overcome in accordance with the concepts of the present invention by providing, in an inverting tow plaiter for handling at least one continuous length of tow and for depositing said tow onto a receiving end of a main conveyor, in such orientation as to permit trouble-free removel of said tow from an opposite discharge end of said main conveyor, the combination with said main conveyor comprising means defining:

an upper tow receiving area and a lower tow discharge area, said discharge area being substantially contiguous with said main conveyor receiving end;

a continuously moving roughened (as distinct from glossy) surface extending in a semicircular path between said tow receiving area and tow discharge area;

means for laying down tow in said tow receiving area in overlying laps extending back and forth on said roughened surface, from side to side, in a direction parallel to the surface axis, said roughened surface having a dimension in said direction sufficient to accommodate the tow laps;

a semicircular housing spaced from said roughened surface and generally coextensive therewith, extending from at least near said tow receiving area to said tow discharge area, said housing defining with the roughened surface a curved chute of narrowing cross-section having a wider gap in the tow receiving area than in the tow discharge area, the gap in the tow discharge area being at least one third the tow average width but sufficiently small to maintain contact of the tow with the roughened surface to said discharge area;

said roughened surface having a speed of rotation approximately the same as the main conveyor;

said laps inverting in orientation in passage in said chute, between the receiving area and the tow discharge area.

In a preferred embodiment, the continuously moving roughened surface comprises a continuously moving belt which defines in the tow receiving area, a relatively flat inclined path of travel immediately prior to the semicircular path of travel between the tow receiving area and tow discharge area.

It is also a preferred embodiment of the present invention that the continuously moving roughened surface be a canvas belt or web.

DESCRIPTION OF THE DRAWINGS

Preferably the apparatus of the present invention is for large commercial dryers, the main conveyor being a dryer belt conveyor. The present invention and advantages thereof will become apparent upon consideration of the following specification, with reference to the accompanying drawing, in which.

Figure 1:
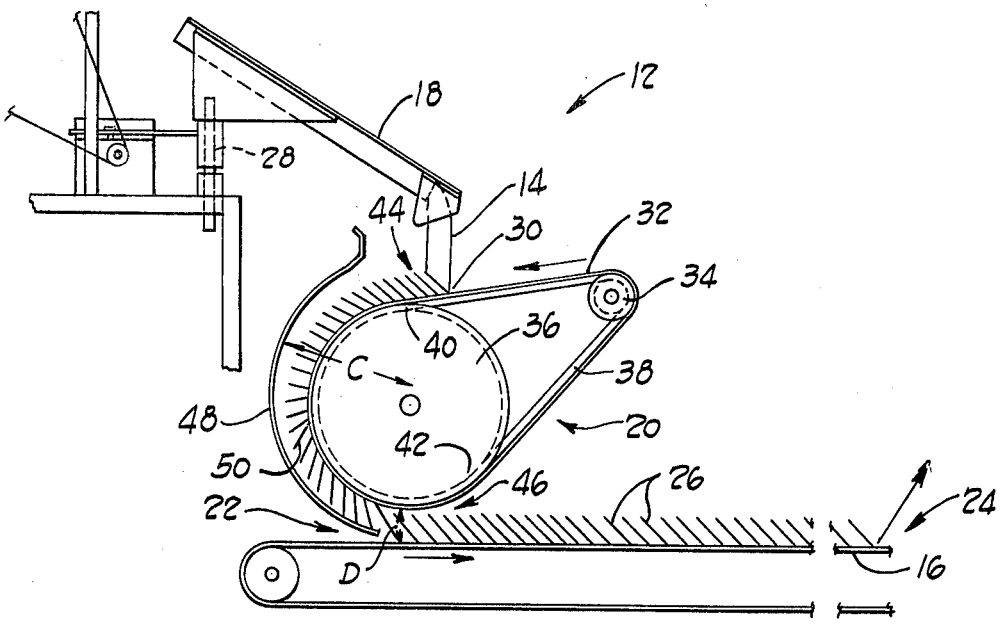
FIG. 1 is an elevation section view of a tow plaiting apparatus in accordance with the concepts of the present invention.

Referring to the drawings, there is illustrated a plaiting apparatus 12 for plaiting polyester, nylon, or rayon tow 14 onto a dryer conveyor 16 in accordance with the concepts of the present invention. In the drawings, there is illustrated an upper tow feeding chute 18 and a lower inverting apparatus 20 for inverting the tow plaits, all in combination with the main conveyor belt 16, for a dryer not shown. It is understood that the dryer can be of any conventional design, of the type employing a continuous conveyor for conveying the goods to be dried through the dryer. An example of one such dryer is shown in co-pending application No. 943,327, filed Sept. 18, 1978, now U.S. Pat. No. 4,195,418 dated Apr. 1, 1980 by Lloyd F. Sturgeon, et al, assigned to assignee of the present application. The title for Serial No. 943,327 is "Improvement in Zoned Heat Treating Apparatus"

As illustrated in the figures, the main dryer conveyor 16 is essentially horizontal in orientation and has a first tow receiving end 22 and an opposite discharge end 24. The inverting apparatus 20 is positioned at the tow receiving end 22, and usually tow is pulled vertically upward or substantially horizontally from the opposite tow discharge end 24. Accordingly, it is a critical aspect of the present invention that the tow be deposited, at the tow receiving end, in a plurality of successive folds or plaits 26, oriented in a substantially upright position as shown, with a leading fold or plait slightly overlying successive folds or plaits. This ensures trouble-free removal of the tow at the discharge end 24.

Figure 2:
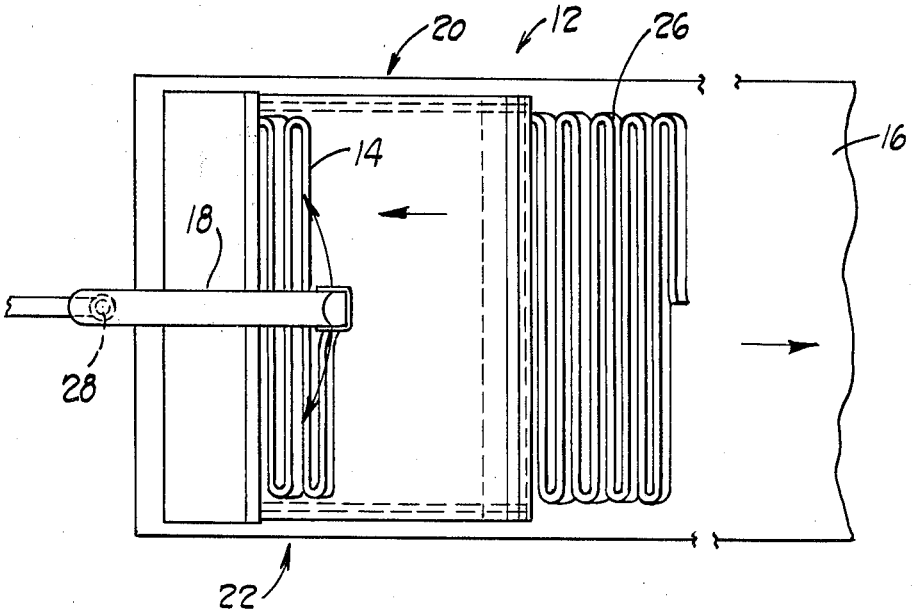
FIG. 2 is a plan view of the apparatus of FIG. 1.

Initially, the tow is passed into the tow feeding chute 18 from the top, the chute being generally inclined at about 45° to the horizontal and being adapted to reciprocate or pivot on pivot post 28, from side to side, as viewed from the top in FIG. 2. Immediately beneath the chute 18, is a slightly inclined flat area 30 of a canvas, continuous, conveyor belt 32, to be described in more detail. Reciprocation of the lower end of the tow feeding chute 18 causes the tow to be laid down on the inclined surface 30 in a series of folds or laps which, in operation, may be from three to six feet in length. The tow may be moving at a speed of about 400–600 feet per minute. In the case of a four foot traverse, this requires that the chute 18 reciprocate at a rate of about 50 cycles per minute, a cycle being from one side to the other and back.

The tow mass itself as mentioned above is a variable and mangled bundle of thin filaments, which by way of example only, may have cross-sectional dimensions ranging from $1\times12$ inches to $2\times6$ inches. The actual mass flow is normally measured in terms of weight per minute, specifically deniers, defined as the weight in grams of a 9,000 meter length of tow. Again, by way of example only, the weight of tow processed may be from 200,000 to 1.5 million or more deniers per minute.

In the embodiment of the Figures, the canvas belt 32 is a continuous, smooth, canvas web extending between a first drive roller 34 and a sheet metal drum 36 of much larger diameter than the drive roller. The drum illustrated in the drawings is approximately 24 inches in diameter, although this may be varied. Generally speaking, the larger the diameter of the drum the better, for reasons which will become apparent, although constructing the apparatus of the present invention with an excessively large drum diameter, for instance six feet, simply becomes impractical.

For the purpose of facilitating drive of the drum, it may be desirable to employ a pair of V-belts 38 adapted to run along opposite sides of the conveyor web, the canvas belt being attached to the V-belts by means of any suitable adhesive.

It is clear from FIG. 1 that the inclination of belt 32 at surface 30 is obtained by the relative dimensions and positioning of the drive roller 34 and drum 36. As illustrated, the path of travel of the canvas belt is to a point of tangency 40 slightly displaced, in a counter-clockwise direction, a few degrees from the drum twelve o'clock position. From that point of tangency the canvas continues around the periphery of the drum to a second point of tangency 42 at about the four o'clock position, although this latter position is not critical as long as the belt remains in contact with the drum to at least about the six o'clock position.

The axis of the sheet metal drum 36 lies directly above the receiving end 22 of the main conveyor 16, and the surface of the drum at the six o'clock position is spaced from the main conveyor a distance D sufficient to accommodate the tow plait in a folded and lapped condition. The apparatus thus defines an upper tow receiving area 44 and lower tow discharge area 46. Preferably, the tow receiving area is along the flat, slightly inclined surface 30 immediately clockwise of the point of tangency 40. The tow discharge area is essentially vertically beneath the axis of the drum.

An outer semicircular housing 48 generally coextensive in an axial direction with the drum surface extends between the tow receiving and discharge areas. The housing has a radius C which is somewhat larger than the radius of the drum, for instance about ⅓ larger. In addition, the center of curvature for the housing is positioned slightly above the axis of the drum, but in the same vertical plane as the axis. The result is that at the tow receiving area of the apparatus, it is spaced a distance from the drum slightly greater than in the discharge area, thus defining a narrowing chute 50 down to the discharge area. The housing 48 is adjustable to and away from the surface of the drum, by any known mechanism (not shown). Similarly, the drum is adjustable, again by known mechanisms, in a vertical direction to vary the dimension D. The following table illustrates how the dimensions C and D may vary depending upon tow width employed.

TABLE

| Tow Width | C | D |
|---|---|---|
| 8–10" | 17" | 4–4½" |
| 6–8" | 16" | 3–3½" |

In operation, the tow is deposited continuously onto the slightly inclined upper surface 30 of the canvas web, at a rate sufficient to lay down approximately four or five laps to the point of tangency 40. The folds can have an overlap of from 50% to 90%. The overlap is approximately 80% in the drawing.

The main conveyor 16 is operated at a speed of about 1–20 feet per minute, for instance about six feet per minute, although this obviously is quite variable, depending upon the type of drying being carried out, the nature of the fabric being dried, and other processing conditions. The drum should be operated at approximately the same speed, plus or minus about 25%. If the drum is operated at a slightly faster speed, there will be a tendency for some compaction in the tow discharge area 46, which may or may not be desirable.

It is important that the chute 50 defined by the housing 48 and the surface of the drum have a wide-mouth upper end to avoid catching of the tow in this area. By the same token, the housing below about the nine o'clock position has to be close enough to the drum to prevent the tow from falling off the surface of the canvas. As the surface of the canvas is roughened (as contrasted with glossy), although the canvas preferably is actually a relatively smooth fabric, the tow moves in the chute with or at the same rate as the canvas. For this purpose, the dimension between the housing 48 and the surface of the canvas, at about the 9 o'clock position, should be somewhat less than the tow width; for instance about five inches for eight to ten inch wide wet tow (having a moisture content of about 10% fed at the rate of about 1.5–2 million deniers per minute). For a wet tow of six to eight inches in width, being fed at the rate of about 400,000 deniers per minute, a three inch spacing should be sufficient.

The dimension D has to be sufficiently small to avoid extensive separation of tow from the surface of the canvas. By the same token, the dimension D cannot be too small as to cause a restriction preventing free movement of the tow. As a general rule, the dimension D should be at least ⅓ the tow width, preferably about ½ the tow width.

Concerning the drum diameter, the larger this diameter, the more effective it will be in the tow inverting process. As a general rule, the diameter of the drum will be five times the dimension D up to about 12 times the dimension D, although the upper limit is not critical. Again, it becomes simply a matter of practicality.

In operation, the tow is deposited on the upper surface of the drum as desired, and remains there for the approximate 180° turn without slipping either forward, or hanging up, or falling off the surface. The degree of roughness on the surface of the canvas is important. A very coarse or rough surface is likely to cause entanglement. Some roughness, however, is necessary to avoid slippage. The actual roughness required depends upon the material involved, and other conditions, and would be known to those skilled in the art.

As an alternative to using a relatively smooth canvas extending between the drive roller and the main drum, it is possible to employ simply a drum with a smooth canvas covering it. In such case, the tow would be folded onto the uppermost edge of the drum. One problem with this arrangement is that it is possible for the tow to slip backwards off the drum, in a clockwise direction, although a stationary plate can be disposed at this point to prevent such slippage.

A further alternative is use of a drum which has been painted with a slightly roughened surface, sufficient to cause the plaits or laps of tow to move with the surface.

The present invention has been described with respect to apparatus for laying down a single series of laps onto a conveyor of about four to six feet in width. It is possible to adapt the principles of the present invention to even wider conveyors, for instance a dryer conveyor having a width of about eight feet. The arc required of chute 18 for laying down eight foot long laps could result in non-uniform transfer of tow to the lower main conveyor 16. In such a case, better results can be obtained by employing a pair of chutes 18, side-by-side, each having an arc traverse of about four feet. Drum 36 would have an axial width of about eight feet, as would canvas belt 32. The inclined canvas surface 30 would thus receive two lengths of tow, each placed there in four foot laps, the laps being side-by-side or in abutting relationship on the belt.

What is claimed is:

1. An inverting tow plaiter for handling at least one continuous length of tow and for depositing said tow onto a receiving end of a main conveyor, in such orientation as to permit trouble-free removal of said tow from an opposite discharge end of said main conveyor, the combination with said main conveyor comprising (a) means defining an elongated transversely extending upper tow receiving area and an elongated transversely extending lower tow discharge area, said discharge area being substantially contiguous with said main conveyor receiving end;

(b) a continuously moving roughened surface defined by a rough belt running on a cylindrical drum and extending along a semi-circular path between said tow receiving area and said tow discharge area;

(c) means for laying down tow in said tow receiving area in overlying laps extending back and forth in an axial direction relative to said drum on said roughened surface, said roughened surface having an axial length sufficient to accommodate the tow laps;

(d) a generally semi-circular housing having an axis parallel to and generally in the same vertical plane as the axis of said drum, said housing axis being located above the axis of said drum, said housing being spaced from said roughened surface and generally axially coextensive therewith, and extending from at least near said tow receiving area to said tow discharge area, whereby said housing defines with the roughened surface a curved chute of continuously narrowing cross-section having a wider gap in the tow receiving area than in the tow discharge area, the radial gap in the tow discharge area being at least one third the tow average width but sufficiently small to maintain contact of the tow with the roughened surface to said discharge area;

(e) said roughened surface having a speed of rotation approximately the same as the main conveyor;

(f) said laps inverting in orientation by rotation about a longitudinal marginal edge of said tow in passage in said curved chute between the receiving area and the tow discharge area.

2. The apparatus of claim 1 including means providing a relatively flat surface in said tow receiving area adapted to prevent movement of the tow other than into said curved chute.

3. The apparatus of claim 2 wherein said roughened surface comprises a continuously moving belt which defines in the tow receiving area a relatively flat, inclined path of travel immediately upstream of the semi-circular path of travel between the tow receiving area and the tow discharge area.

4. The apparatus of claim 3 wherein said continuously moving belt is a canvas belt.

5. The apparatus of claim 4 wherein said main conveyor is a dryer conveyor.

6. An inverting tow plaiter for handling at least one continuous length of tow and for depositing said tow onto a receiving end of a main conveyor, in such orientation as to permit trouble-free removal of said tow from an opposite discharge end of said main conveyor, the combination with said main conveyor comprising (a) means defining an elongated transversely extending upper tow receiving area and an elongated transversely extending lower tow discharge area, said tow discharge area being substantially contiguous with said main conveyor receiving end;

(b) a continuous moving canvas belt;

(c) means including a cylindrical drum mounted for rotation on a horizontal axis for confining said belt to a substantially semi-circular path of travel from said tow receiving area to said tow discharge area, and a slightly inclined substantially flat path of travel upstream of the tow receiving area;

(d) means for depositing said tow in overlying laps extending back and forth on said belt in an axial direction relative to said drum and in said tow receiving area; and (e) a generally semi-circularly configured housing having an axis parallel to and generally in the same vertical plane as the axis of said drum, said housing axis being located above the axis of said drum said housing being spaced from said belt generally coextensive therewith in an axial direction whereby said housing defines with the exposed surface on said drum a curved chute of continuously narrowing cross-section having a wider gap in the tow receiving area than in the tow discharge area, the radial gap in the tow discharge area being at least one third the tow average width but sufficiently small to maintain contact of the tow with the canvas belt to said discharge area, (f) said laps inverting in orientation by rotation about a longitudinal marginal edge of said tow in passage in said chute between the receiving area and the tow discharge area.

* * * * *